United States Patent [19]

Guinan

[11] 4,267,539

[45] May 12, 1981

[54] CIRCUIT BREAKER HAVING A CAM FOR EXTERNAL ADJUSTMENT OF ITS TRIP POINT

[75] Inventor: Thomas Guinan, Hamilton Township, Mercer County, N.J.

[73] Assignee: Heinemann Electric Company, Trenton, N.J.

[21] Appl. No.: 63,270

[22] Filed: Aug. 2, 1979

[51] Int. Cl.[3] ..... H01H 71/74

[52] U.S. Cl. ..... 335/42; 335/45; 335/176

[58] Field of Search ..... 335/42, 45, 174, 176

[56] References Cited

U.S. PATENT DOCUMENTS

| | | | |
|---|---|---|---|
| 2,934,620 | 4/1960 | Middendorf | 335/45 |
| 3,329,913 | 7/1967 | Camp | 335/174 |
| 3,831,120 | 8/1974 | Powell et al. | 335/176 |
| 3,855,557 | 12/1974 | Gryctko | 335/42 |

*Primary Examiner*—Harold Broome

*Attorney, Agent, or Firm*—Joseph G. Denny, III; Peter J. Patane

[57] ABSTRACT

A circuit breaker comprising a solenoid coil, an armature actuatable by the coil and a magnetizable frame carrying the coil enclosed with a case comprising two abutting half-cases. A time delay device comprising a tube of non-magnetic material within which is a movable magnetizable core and with which the coil cooperates to actuate the armature after a time delay period upon predetermined energization of the coil. The tube has a pole piece at one end and the armature has an attractable portion which moves toward said pole piece on predetermined overload conditions, the core being biased toward the end of the tube away from the pole piece. An adjustable cam is carried between said half-cases. Said attractable portion of the armature being biased by a spring into engagement with said cam and away from said pole piece. Said cam being rotatable to vary the air gap between said pole piece and said attractable portion of the armature, whereby the trip point of the circuit breaker may be varied.

5 Claims, 3 Drawing Figures

CIRCUIT BREAKER HAVING A CAM FOR EXTERNAL ADJUSTMENT OF ITS TRIP POINT

BACKGROUND OF THE INVENTION

This invention relates to circuit breakers in which overload sensing is accomplished electromagnetically by a sensing device which permits the circuit breaker to actuate after a time delay period at certain overloads and with substantially no time delay at other overloads. Such circuit breakers are illustrated, for example, in U.S. Pat. No. 2,360,922, issued to Kurt W. Wilckens, and U.S. Pat. No. 3,329,913, issued to William W. Camp.

These prior patents disclose an electromagnetic sensing device including a solenoid coil, a time delay tube housing a movable core of magnetizable material movable against the retarding action of a liquid to provide a time delay upon the occurrence of an overload and a pivotal, spring biased, armature. If the overload current is below a certain value and if it does not persist for a predetermined time, it will not cause tripping by the armature of the circuit breaker's operating mechanism and will not open the circuit breaker contacts, thereby avoiding nuisance tripping. However, if the overload current is sufficiently high, the resulting magnetic flux will substantially instantaneously cause the armature to pivot and trip the circuit breaker operating linkage mechanism, opening the circuit breaker contacts substantially instantaneously, i.e., with no intentional time delay.

It is the usual practice to construct and adjust such a circuit breaker so that it will carry the rated current without tripping. The circuit breaker may trip when the current is above 100% of rated current and below 125% of rated current after a time delay period. The circuit breaker must trip when the current is 125% of rated current or above (after a time delay period below very high overloads). The circuit breaker will trip substantially instantaneously (with no intentional delay) at substantially higher overloads, for example, 800% of rated current.

The trip point adjustment has heretofore been made by adjusting the spring tension biasing the armature attracted arm away from the pole piece of the solenoid coil and by adjusting the air gap between the attracted arm and the pole piece.

It is an object of this invention to provide a means to variably adjust the trip point of the circuit breaker without varying the spring tension on the armature.

It is another object of this invention to provide a means for adjusting the trip point of the circuit breaker from outside the circuit breaker so that the trip point may be adjusted after the circuit breaker has been fully assembled.

It is a further object of this invention to provide a one piece device of simple and economical construction for externally adjusting the trip point of the circuit breaker.

BRIEF SUMMARY OF THE INVENTION

This invention is embodied in a circuit breaker comprising a case including two abutting half-cases and a solenoid coil. A pivotal armature is provided by the coil, the coil having a pole piece at one end. The armature has an unlatching arm and an attractable arm movable toward the pole piece upon predetermined energization of said coil. Further, a linkage mechanism is provided including a latch engaged by the unlatching arm of the armature to trip the linkage mechanism on predetermined energization of the coil. This invention provides a one piece rotatable cam engaging the attractable arm and a spring for biasing the attractable arm toward the cam. The cam is carried by the half-cases and is accessible from the exterior of the case for rotating the cam and varying the air gap between the attractable arm of the armature and the pole piece, whereby the trip point of the circuit breaker may be varied from the exterior of the circuit breaker.

The foregoing and other objects of this invention, the princples of this invention, and the best modes in which I have contemplated applying such principles will more fully appear from the following description and accompanying drawings in illustration thereof.

BRIEF DESCRIPTION OF THE VIEWS

DETAILED DESCRIPTION

Figure 1:
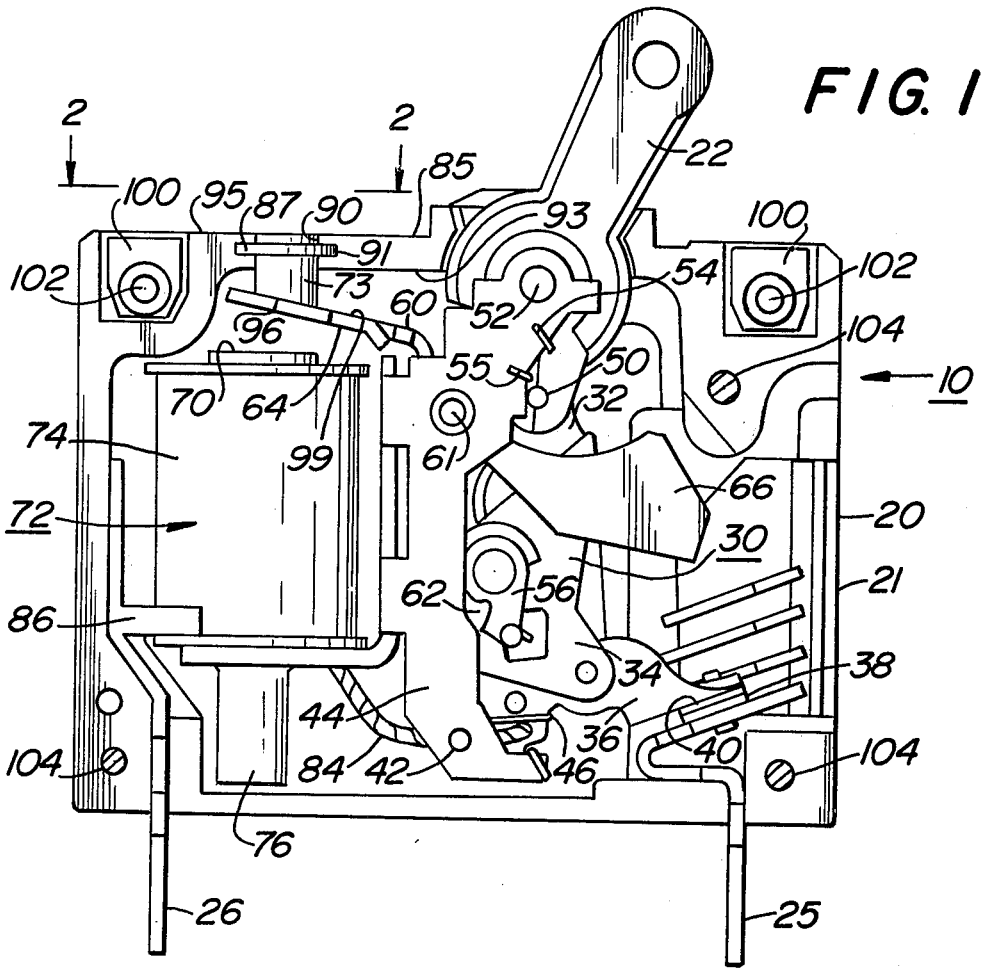
FIG. 1 is a side elevation, illustrating a circuit breaker incorporating this invention, with one-half case removed to show the general internal arrangement and illustrating the contacts in the closed position.
Figure 2:
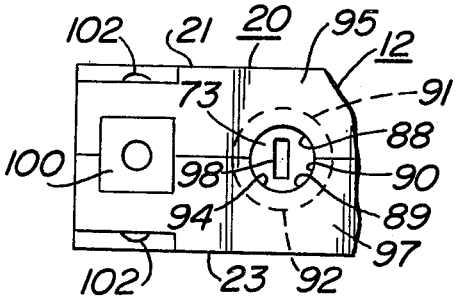
FIG. 2 is a partial top view of the circuit breaker illustrated in FIG. 1 showing portions of the two half-cases.
Figure 3:
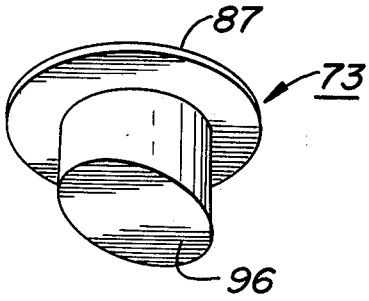
FIG. 3 is a perspective view of the cam for adjusting the trip point of the circuit breaker.

Referring to the drawings, FIG. 1 illustrates a circuit breaker 10 generally similar to the one disclosed and claimed in U.S. Pat. No. 3,329,913, issued to William W. Camp, and assigned to the Heinemann Electric Company. For a more complete description of the mechanism of this circuit breaker reference should be made to the aforementioned patent, but for clarity, the circuit breaker may be briefly described as comprising an insulating case 20 formed by abutting substantially half-cases 21 and 23, only the half-case 21 being illustrated in FIG. 1, an operating handle 22, and terminals 25 and 26 for connecting the circuit breaker to a load. Connected to the operating handle 22 is a linkage 30 comprising toggle links 32 and 34 and a movable arm 36. The terminal 25 supports a stationary contact 38 which cooperates with a movable contact 40, the latter being carried by the movable arm 36. The movable arm 36 pivots about a pintle 42, carried by a frame 44, and is biased by a spring 46 to the open position of the contacts.

The toggle link 34 is pivotally connected to the movable arm 36 at one end and to the toggle link 32 at the other end to form the knee of the toggle, the link 32 being pivotally connected at its upper end to the handle 22 by a pintle 50. The handle 22 oscillates about a fixed pintle 52 which is carried by the frame 44 and is biased to the "off" position of the contacts by a reset spring 54, the spring 54 also resetting the toggle linkage upon tripping of the mechanism.

For locking the toggle in the overcenter position during automatic resetting, the toggle link 32 engages a latch 56 carried by the link 34.

The latch 56 is tripped by a pivotal armature 60 having three arms, namely an unlatching arm 62, an attracted arm 64 and a balance arm 66. The unlatching arm 62 engages the latch 56 and turns it to unlatch the toggle, thereby allowing the toggle to collapse under the bias of the spring 46, when the armature arm 64 is attracted (upon sufficient overload), toward the pole piece 70 of an electromagnet device 72. The armature 60 is pivotally mounted on a pintle 61 carried by the frame 44 and biased by a spring 55 is the clockwise direction, as viewed in FIG. 1, biasing the attracted end 64 away from the pole piece 70 and into engagement with the cam 73 of this invention.

The electromagnetic device 72 further comprises a solenoid coil 74 about a tube 76. The tube 76 is of non-magnetic material and houses a movable core (not shown) of magnetizable material biased by a spring (not shown) toward the lower end of the tube and is retarded in its upward movement by a liquid, preferably a silicone oil, within the tube 76 to provide a time delay below certain overload currents before tripping of the circuit breaker takes place. The coil 74 has one end connected to the movable arm 36 by a flexible conductor 84 and the other end connected by a conductor 86 to the terminal 26. Thus, an electromagnetic tripping device or sensing element is formed by the coil 74, the tube 76, the movable core (not shown), and the armature 60 for tripping the circuit breaker after a time delay period at certain overloads or substantially instantaneously at other, higher overloads.

The half-cases 21 and 23 are each provided with semi-circular holes 88 and 89 together defining a circular hole 90 extending from the interior of the case 20 to the exterior, as shown.

The semi-circular holes 88 and 89 are each provided with semi-circular recesses 91 and 92 to jointly define a circular recess 94 in the top walls 95 and 97 of the half-cases 21 and 23 intermediate the interior surface 93 and the exterior surface 85 immediately above the armature arm 64. The uppermost portion of the cam 94 has an outwardly extending flange 87 frictionally received in the semi-circular recesses 91 and 92. The cylindrical lower portion of the cam 73 below the flange 87 is also frictionally received in the circular hole 90 so that the cam 73 will retain its position unless intentionally rotated.

The cam 73 is disposed immediately above the armature arm 64, as shown in FIG. 1, in the recess 94. The cam 73 extends down toward the arm 64 and has an inclined lower surface 96 against which rest the attractable arm 64, the attractable arm being biased against the surface 96 by the spring 55. The surface 96 is inclined parallel to the upper surface 99 of the armature arm 64 so that in the position shown in FIG. 1 the cam surface 96 is in full contact with the armature upper surface 99 when the air gap between the arm 64 and the pole piece 70 is at a maximum. However, the surface 96 and the surface 99 need not be parallel to each other. Further, the extent of the inclination of the surface 96 will depend on the range of adjustment of the armature arm 64 which is desired. The cam 73 is preferably molded as a one piece member from a plastic, electrical insulating material.

The cam 73 has an upper surface formed with a slot 98 to receive a suitable tool for rotating the cam 73 and the surface 96. As the surface 96 rotates, the lowest portion of the surface 96 will move to the left, as viewed in FIG. 1, causing the armature arm 64 (which is biased against it) to pivot down toward the pole piece 70. In FIG. 1 the position of the cam 73 is such as to provide the maximum space, that is, the maximum air gap, between the armature arm 64 and the pole piece 70. When the cam 73 is rotated 180° from the position of FIG. 1 the armature arm 64 will be moved down to its minimum spacing, that is, the minimum air gap, between the armature 64 and the pole piece 70.

To further assure that the cam 73 retains its position, the portion of the hole 90 above its upper surface may be cemented to the top walls 95 and 97 by filling the hole 90 with a suitable adhesive or sealant (not shown). The adhesive or sealant will also tend to prevent tampering (by unauthorized persons) with the setting of cam 73.

As is the usual practice in these circuit breakers, the two half-cases 21 and 23 are held together by fastener inserts 100 having arms 102 extending through the half-cases and then peened over. Also, fastener rivets 104 extend through the half-cases 21 and 23 to further secure them together.

From the foregoing it is seen that this invention provides a cam 73 of one piece construction which is simple and economical. The cam 73 is carried by the case 20 adjacent to and in contact with the armature arm 64. After the circuit breaker 10 is fully assembled, by rotating the cam 73 from outside the case 20, the position of the armature arm 73 may be easily varied relative to the pole piece 70, thus easily varying the trip point of the circuit breaker for a given energization of the coil 74. After the trip point is thus set at the desired value, the sealant may be added in the hole 90 upon the upper surface of the cam 73 to minimize tampering with the cam 73.

What I claim is:

1. A circuit breaker comprising
a case incuding two abutting half-cases
a solenoid coil,
a pivotal armature actuatable by said coil,
a pole piece at one end of said coil,
said armature having an unlatching portion and an attractable portion movable toward said pole piece upon predetermined energization of said coil,
a linkage mechanism including a latch engaged by said unlatching portion of said armature to trip said linkage mechanism on predetermined energization of said coil,
a rotatable cam engaging said attractable portion, and
a spring for biasing said attractable portion toward said cam,
said cam being carried by said half-cases,
said cam being accessible from the exterior of said case for rotating said cam and varying the air gap between said attractable portion of said armature and said pole piece, whereby the trip point of the circuit breaker may be varied,
said cam including a cylindrical portion and a circular flange,
said half-cases including semi-circular openings jointly defining a circular opening,
said cylindrical portion being received within said circular opening, and
said circular opening being undercut to receive said flange,
whereby said cam is carried by said half-cases, but may be rotated within said opening to move said armature attractable portion toward or away from said pole piece.

2. The combination of claim 1 wherein
said cam has an end portion accessible from the outside of said case,
said end portion having a slot to receive a tool for facilitating the rotation of said cam.

3. The combination of claim 2 wherein a sealant covers the end portion of said cam which is accessible from the outside of said case if resistance to tampering with the setting of the circuit breaker is desired.

4. The combination of claim 2 wherein said cam is a one piece member.

5. The combination of claims 1 or 3 and further including fasteners for securing together said half-cases and retaining said cam to said half-cases.

* * * * *